United States Patent [19]

Stelcher et al.

[11] Patent Number: 4,497,420

[45] Date of Patent: Feb. 5, 1985

[54] LABEL DISPENSER

[75] Inventors: William N. Stelcher, Deerfield, Ill.; Michael J. Murdock, Bristol, Wis.

[73] Assignee: Kinetronics Corporation, Lake Bluff, Ill.

[21] Appl. No.: 378,128

[22] Filed: May 14, 1982

[51] Int. Cl.[3] ..... B65C 9/42

[52] U.S. Cl. ..... 221/13; 221/73; 156/361; 156/584; 156/DIG. 33; 156/DIG. 45; 242/67.3 R; 242/68.3

[58] Field of Search ..... 156/DIG. 24, DIG. 27, 156/DIG. 33, DIG. 44, DIG. 45, DIG. 28, DIG. 37, DIG. 42, DIG. 46, DIG. 47, DIG. 49, 384, 577, 579, 584, 361; 221/13, 69, 70, 71, 72, 73; 242/67.3 R, 68.3; 250/221

[56] References Cited

U.S. PATENT DOCUMENTS

| | | | |
|---|---|---|---|
| 2,156,176 | 4/1939 | Cavanaugh | 242/67.3 R |
| 3,369,952 | 2/1968 | Rieger | 221/73 X |
| 3,403,066 | 9/1968 | Ikelheimer | 221/73 |
| 3,568,881 | 3/1971 | Croney | 221/13 |
| 4,272,762 | 6/1981 | Geller et al. | 250/221 X |
| 4,402,424 | 9/1983 | Mattix | 221/13 |

FOREIGN PATENT DOCUMENTS

| | | | |
|---|---|---|---|
| 1411517 | 3/1970 | Fed. Rep. of Germany | 221/71 |
| 1130622 | 10/1956 | France | 221/73 |

*Primary Examiner*—Joseph J. Rolla
*Assistant Examiner*—Lawrence J. Miller
*Attorney, Agent, or Firm*—Hill, Van Santen, Steadman & Simpson

[57] ABSTRACT

A label dispenser which utilizes an infrared radiator and sensor which is phased and modulated so as to discriminate from ambient light and which has a movable peel bar which can be adjusted for labels of different lengths such that as the labels are removed the machine will automatically advance the next label. The machine is capable of taking labels of varying widths.

1 Claim, 6 Drawing Figures

LABEL DISPENSER

BACKGROUND OF THE INVENTION

1. Field of the Invention

This invention relates in general to an automatic label dispenser.

2. Description of the Prior Art

It is often necessary to provide labels on various items and prior art label dispensers have utilized foot switches which were operated by the operator or, by microswitches which are actuated so as to dispense the next label.

SUMMARY OF THE INVENTION

The present invention comprises a completely automatic label dispenser for use in photo labs, mailers, hospitals, microfilm labs, retail stores and any business using self-adhesive labels and is capable of dispensing self-adhesive labels up to three by three inches. High technology electronics integrated circuits and infrared sensing are used in the label dispenser to automatically dispense the labels. It dispenses the entire range of self-adhesive labels from small photo print check labels to labels up to three by three inches.

The label dispenser dispenses, peels and separates labels from the carrier paper and advances subsequent labels automatically. The fully adjustable peel bar enables precise adjustment for labels of all sizes. The paper backing from the dispensed labels is neatly wound away from the operator for subsequent removal from the machine.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
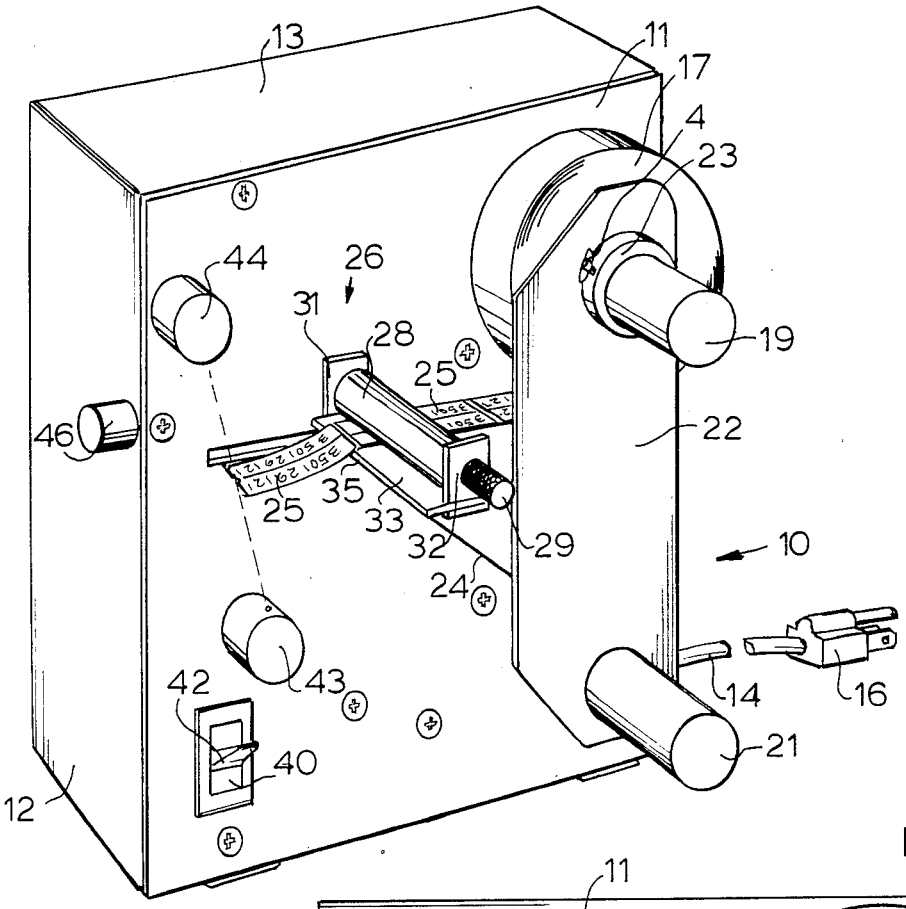
FIG. 1 is a front perspective view of the label dispenser of the invention.
Figure 3:
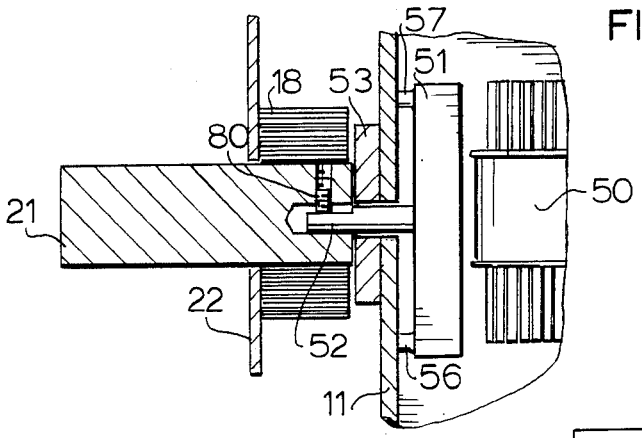
FIG. 3 is a sectional view illustrating the motor drive for the take-up reel.
Figure 4:
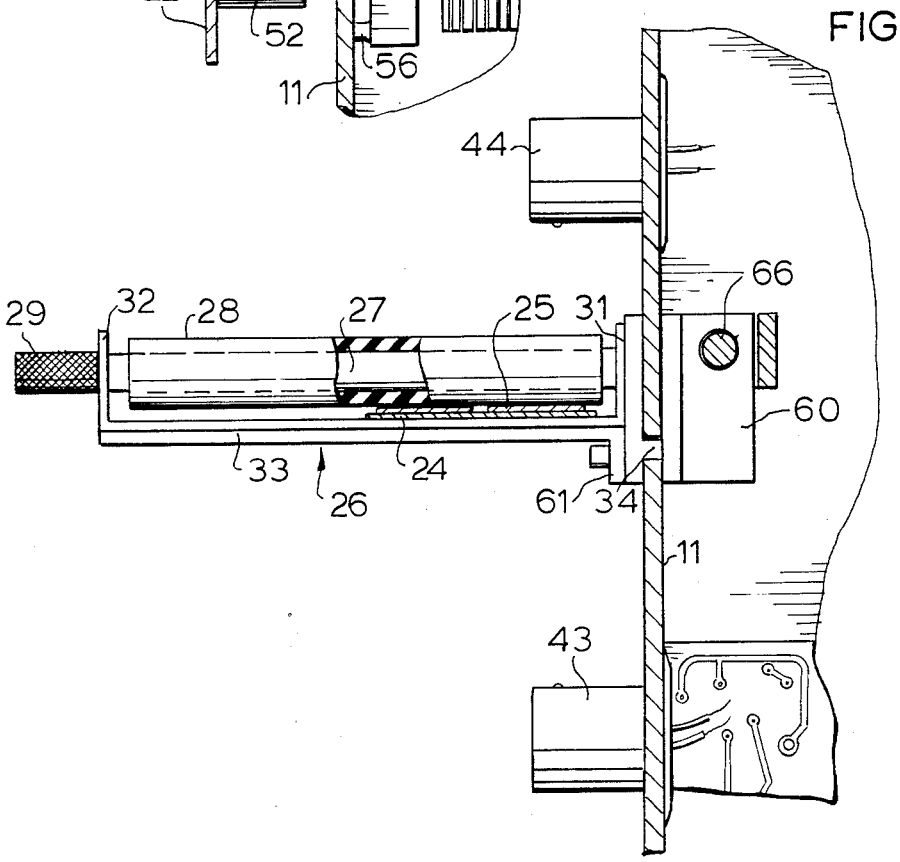
FIG. 4 is a sectional view illustrating the adjustable peel bar and infrared transmitter and receiver.

FIG. 1 illustrates the automatic label dispenser 10 of the invention which comprises a case with a front cover 11 and side walls 12 and 13. A reel 17 of carrier paper with labels attached thereto is mounted on a shaft 19 and an adjustable plate 22 is formed with an opening through which the shaft 19 extends and a second opening through which the take-up shaft 21 extends and a collar 23 can be adjusted by the thumb screw 4 to adjust the width for the width of the labels 25. The paper 24 and labels 25 pass from the reel 17 over a peel bar 26 mounted on the front cover 11 and the labels 25 separate from the paper 24 which then passes to take-up reel 21 mounted on take-up shaft 18. The take-up shaft 21 is driven by motor 50 through a gear reduction 51 as illustrated in FIG. 3 which has an output shaft 52 which is attached to shaft 21 by a suitable set screw 80 and a collar 53 is mounted between the shaft 21 and the front wall 11 as illustrated. Stand-offs 56 and 57 support the gear reduction 51 and the motor 50 as shown. The paper 24 comprises a backing ribbon.

Figure 2:
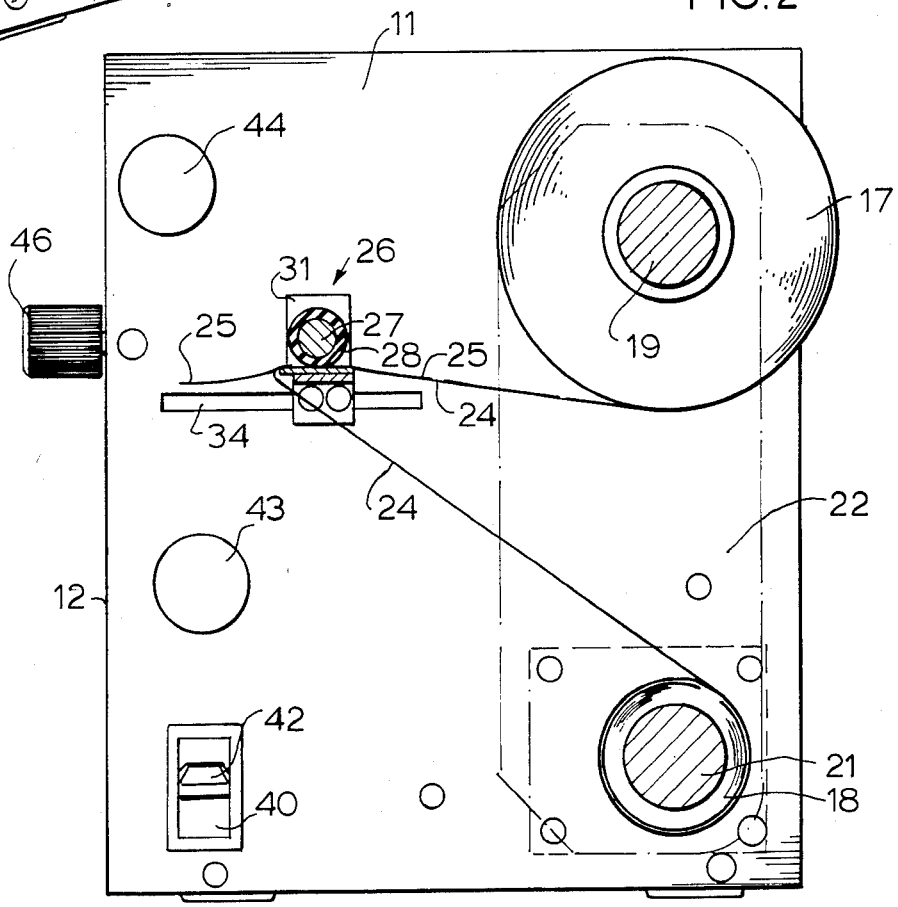
FIG. 2 is a front plan view of the invention.
Figure 5:
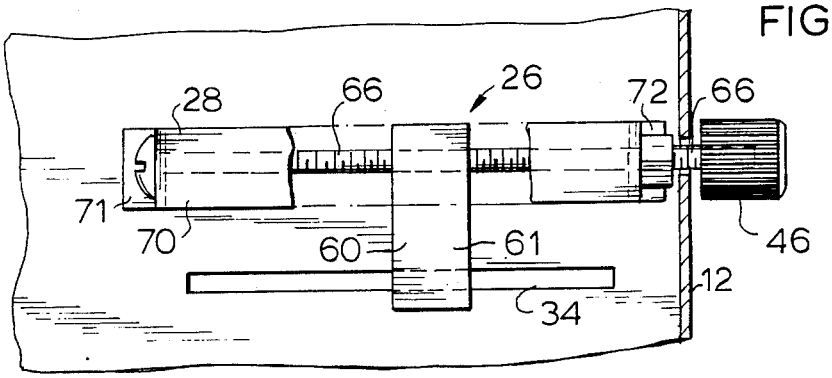
FIG. 5 is a sectional view illustrating the adjustable peel bar.

As shown in FIGS. 1, 2, 4 and 5, the adjustable peel bar 26 comprises a bracket 33 with upwardly extending ends 31 and 32 which rotatably supports shaft 27 which has a knurled knob 29 on its outer end thereof. A flexible covering 28 as, for example, of rubber or other suitable material covers the shaft 27. The shaft 27 comprises a guide shaft. The bracket 33 has a front edge 35 illustrated in FIG. 1 and from this point the labels 25 extend outwardly generally horizontal as illustrated in FIGS. 1 and 2 and the paper 24 passes to the take-up reel 21. An adjustable bracket 60 passes through a slot 34 which is generally horizontal in the front panel 11 and the bracket 60 has a front portion 61 on the outside of the case of the label dispenser which carries the bracket 31 and the adjustable peel bar 26. A shaft 66 extends through the side wall 12 of the case and carries a knob 46 as illustrated in FIGS. 2 and 5. The shaft 66 is rotatably supported in a bracket 70 which has end portions 71 and 72 connected to the plate 11 and the bracket 60, 61 is driven when the knob 46 is rotated so as to turn shaft 66 to move the peel bar 26 to the left or right relative to FIGS. 1, 2 and 5 so as to adjust for the length of a particular label.

As shown in FIGS. 1 and 2, an on-off switch 42 and an indicator light 40 is mounted on the front panel 11 of the label dispenser 10. An infrared transmitter 44 is mounted on the front panel 11 as shown in FIGS. 1 and 2 and an infrared detector 43 is mounted below the label 25 so as to intercept infrared energy transmitted by the radiator 44 when a label 25 is not in the path of the radiation between the transmitter 44 and the detector 43. Power cord 14 with a plug-in plug 16 supplies power to the unit.

Figure 6:
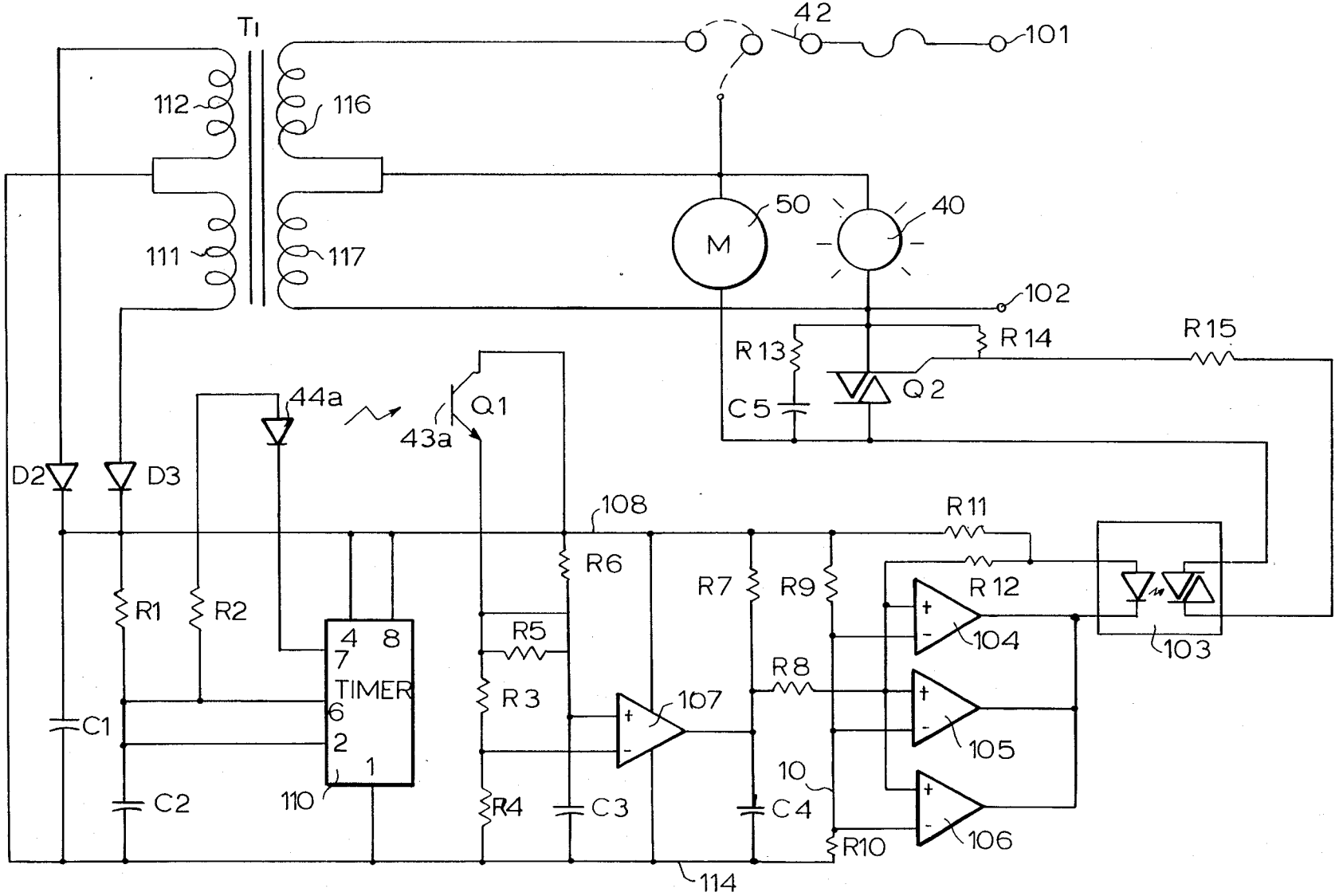
FIG. 6 is an electrical schematic illustrating the circuit of the invention.

FIG. 6 comprises an electrical schematic and illustrates a pair of power terminals 101 and 102 and the switch 42 which can be connected to one terminal of the motor 50 and to the indicator light 40 so as to apply power to the light 40. The other side of the motor is connected to a suitable electronic switch such as a thyristor Q2 which is in parallel with a capacitor C5 and a resistor R13. A resistor R14 is connected from the gate of the thyristor Q2 and the terminal 102. The second side of the motor is connected to the capacitor and the thyristor Q2 as illustrated. A ZVS switch 103 which might be a type 3030 has its output connected to the thyristor Q2 and to the gate and its input is connected to a pair of resistors R11 and R12 and to the output of three comparators 104, 105 and 106 which may be type 3302 for example. A comparator 107 which may be a type 3302 provides inputs to the comparators 104, 105, 106 through a resistor R8. The negative input terminals of the comparators 104, 105 and 106 are connected to a lead 10 which is connected by resistor R10 and capacitor C4 to the output of the comparator 107 and through resistors R9 and R7 to the output of the comparator 107.

The infrared detector 43*a* is connected across a resistor R6 and to lead 108. Resistors R3, R5, R4 and capacitor C3 are connected to the positive and negative inputs of comparator 107 as illustrated.

The timer 110 which might be a type 555 is connected to lead 108 and to the infrared transmitter 44*a* and the resistor R2 as shown. The capacitor C2 is connected between terminals 2 and 1 of the timer 110. A capacitor C1 is connected between terminals 4 and 1 of the timer 110. Diode D3 is connected from lead 108 to a secondary 111 of transformer T1 and the other side of secondary 111 is connected to lead 114. Secondary 112 is connected from lead 114 to a diode D2 which has its other side connected to lead 108. Primaries 116 and 117 are connected as shown.

In operation, a reel 17 of carrier paper 24 and labels 25 are mounted on the pay-out reel shaft 19 and pass through the adjustable peel bar 26. The labels 25 are separated from the carrier paper 24 and the carrier paper 24 is passed around take-up reel 21 which is driven by the motor 50. The shaft 66 is adjusted by turning the knob 46 so that the extending edge of the label 25 intercepts the infrared radiation transmitted by the transmitter 44 so that it does not impinge on the detector 43. In operation, the operator removes the label 25 and places it on a suitable package or envelope and as the label 25 is removed the infrared radiation from the transmitter 44*a* passes to the detector 43*a* which energizes through the comparators 107, 104, 105 and 106 the switch 103 which turns on the thyristor Q2 so as to energize the motor 50 so that it drives shaft 21 through the gear reduction 51. The motor 50 continues to drive until the next label 25 extends outwardly from the edge 35 until it intercepts the infrared radiation between the transmitter 44 and the detector 43. When this occurs, the switch 103 turns off thyristor Q2 which stops the motor 50 until the next label has been removed. The signal on the infrared transmitter 44*a* is modulated with a suitable frequency which is determined by the timer 110 and the resistors R1 and R2 and the capacitors C1 and C2 which eliminates ambient light from passing into the infrared detector 43 and energizing the label dispenser. In other words, the modulation on the transmitted infrared signal from the transmitter 44*a* energizes the label dispenser whereas ambient light which might randomly pass into the detector 43 and which does not have the modulation on it will not energize the machine.

In a particular embodiment, capacitor C1 was a 500 microfarad, capacitor C2 was a 1 microfarad, capacitor C3 was a 0.1 microfarad, capacitor C4 was a 1 microfarad and capacitor C5 was a 0.01 microfarad. The resistor R1 was 680 ohms, resistor R2 was 47 ohms, resistor R3 was 330 ohms, resistor R4 was 3.3k ohms, resistor R5 was 100k ohms, resistor R6 was 10k ohms, resistor R7 was 10k ohms, resistor R8 was 100k ohms, resistor R9 was 200k ohms, resistor R10 was 200k ohms, resistor R11 was 200k ohms, resistor R12 was 200k ohms, resistor R13 was 47 ohms one-half watt and resistor R14 was 1k ohm and resistor R15 was 47 ohms one-half watt.

It is seen that this invention provides an automatic label dispenser wherein the size of the label can be adjusted by moving the adjustable peel bar 26 and also the plate 22 can be adjusted for different widths of labels.

Although the invention has been described with respect to preferred embodiments, it is not to be so limited as changes and modifications can be made which are within the full intended scope of the invention as defined by the appended claims.

We claim as our invention:

1. An automatic label dispenser comprising, a case with at least one planar wall, a take-up shaft mounted on said one planar wall, drive means connected to said take-up shaft, a pay-out shaft mounted on said one planar wall for supporting and supplying backing ribbon with labels mounted thereon, a peel bar mounted on and extending out from said one planar wall and said backing ribbon and labels passing thereby with the backing ribbon passing to said take-up shaft and said labels separated from said ribbon at said peel bar and extending therefrom, infrared transmitting and receiving means mounted on said one planar wall and said receiving means connected to said drive means and positioned such that a label will pass between said transmitting and receiving means to intercept the energy transmitted from said transmitting means to turn off said drive means, including a planar member with openings receivable over said take-up shaft and said pay-out shaft and means for locking said planar member at selected distances from said one planar wall, wherein said means for locking comprises a collar receivable over said pay-out shaft and set screw means to lock said collar to said pay-out shaft, including means for moving said peel bar relative to said one planar wall to adjust for labels of varying lengths, and wherein said peel bar includes a bracket for rotatably supporting a guide shaft and said backing ribbon and said labels passing between said guide shaft and said bracket, wherein said one planar wall is formed with a slot in which said bracket is mounted and means for moving said bracket, and wherein said means for moving said bracket includes a threaded lead screw rotatably supported by said case and threadedly engaged with said bracket such that when said lead screw is rotated said bracket moves in said slot to move said peel bar, wherein said guide shaft has a flexible outer layer and said bracket having an edge for changing the direction of said ribbon to separate said labels from said ribbon, including means for modulating the energy radiated by said infrared transmitting means and means in said receiving means for detecting the modulated energy to discriminate between said radiated energy and ambient radiation, and including switch means connected to said receiving means to energize said drive means.

* * * * *